US008113024B2

(12) United States Patent
Yang

(10) Patent No.: US 8,113,024 B2
(45) Date of Patent: Feb. 14, 2012

(54) DOUBLE-SYSTEM LOCK APPARATUS

(75) Inventor: Ping-Jan Yang, Taipei (TW)

(73) Assignee: Real Locks & Security Co., Ltd., Taipei (TW)

( * ) Notice: Subject to any disclaimer, the term of this patent is extended or adjusted under 35 U.S.C. 154(b) by 299 days.

(21) Appl. No.: 12/575,473

(22) Filed: Oct. 8, 2009

(65) Prior Publication Data

US 2011/0083483 A1 Apr. 14, 2011

(51) Int. Cl.
*E05B 37/00* (2006.01)

(52) U.S. Cl. ..... 70/284; 70/21; 70/69; 70/285; 70/312

(58) Field of Classification Search ..... 70/21, 69–75, 70/284, 285, 312
See application file for complete search history.

(56) References Cited

U.S. PATENT DOCUMENTS 4,557,122 A * 12/1985 Hwang ..... 70/312
4,671,088 A * 6/1987 Jeang ..... 70/312
5,485,734 A * 1/1996 Yang ..... 70/285
5,582,049 A * 12/1996 Mauer ..... 70/312
6,912,880 B2 * 7/2005 Ling et al. ..... 70/71
7,104,092 B2 * 9/2006 Yu ..... 70/21
7,290,417 B1 * 11/2007 Huang ..... 70/285
7,363,782 B1 * 4/2008 Misner et al. ..... 70/21
7,367,207 B2 * 5/2008 Yang ..... 70/284
7,415,853 B2 * 8/2008 Yu ..... 70/68
7,437,899 B1 * 10/2008 Ma ..... 70/69
7,437,903 B2 * 10/2008 Cheng ..... 70/284
7,698,913 B2 * 4/2010 Lee ..... 70/21
2003/0205069 A1 * 11/2003 Knoll ..... 70/26
2004/0011098 A1 * 1/2004 Yang ..... 70/284
2007/0214850 A1 * 9/2007 Ma ..... 70/284
2009/0107193 A1 * 4/2009 Lee ..... 70/284
2009/0145178 A1 * 6/2009 Nave et al. ..... 70/21
2009/0301147 A1 * 12/2009 Yang ..... 70/284
2010/0192641 A1 * 8/2010 Nave ..... 70/24
2010/0257907 A1 * 10/2010 Yu et al. ..... 70/284

* cited by examiner

*Primary Examiner* — Suzanne Barrett
(74) *Attorney, Agent, or Firm* — Chun-Ming Shih; HDLS IPR Services

(57) ABSTRACT

A double system lock apparatus comprises a lock shell, a combination lock, a key lock, and a control piece set. The lock shell has a panel and a main base assembled with each other. The combination lock has a plurality of rotating discs, coupling springs, couplings, and a shaft. The key lock has a lock cylinder and a sleeve set. From back to front, the control piece set has a first control piece, a second control piece, and a third control piece. By means of the control piece set working between the combination lock and the key lock, a double system lock apparatus of simple structure but well function has been formed.

10 Claims, 7 Drawing Sheets

DOUBLE-SYSTEM LOCK APPARATUS

BACKGROUND OF THE INVENTION

1. Field of the Invention

The present invention relates to a lock apparatus, in particular, one which is a double system lock apparatus having a combination lock and a key lock.

2. Description of Related Art

Locks are widely used in daily life. In general, the way to use a lock apparatus is to insert a key into a lock associated with a closing device, including, for example, doors, boxes, cabinets, lockers and other such items in need of theft prevention. However, if the user loses the key of the lock apparatus, it will be at least annoying, and possibly disastrous for the user. Therefore, a kind of double-system lock apparatus combining a key lock and a combination lock has been developed. If the user carries the key of the double-system lock to the lock apparatus at one time, he/she can use the key to unlock the double system lock apparatus. On the other hand, if the user forgets to bring the key, he/she can dial/rotate a plurality of the rotating discs of the combination in the right numbers to unlock the double system lock apparatus. In this way, the double-system lock apparatus brings the user at least convenience, possibly safety and more.

The double system-lock apparatus does not present problems, though the concept of the structure of the double system lock apparatus is complex, especially for managing the working elements between the key lock and the combination lock of this useful double-system lock.

SUMMARY OF THE INVENTION

The main object of the present invention is to provide a double-system lock apparatus of which the structure is simple, easy, and convenient to the user.

To attain the object mentioned above, the present invention provides a double system lock apparatus, comprising: a lock outer case or shell, having a panel and a main base assembled with each other, wherein the panel has a opening passing through it and a plurality of windows arranged in a functional fashion, an easy one of which is a row, and the main base has a locating ring, an opening passing through it, and a plurality of flat bases; a combination lock, having a plurality of rotating discs, coupling springs, couplings, and a shaft, wherein the rotating discs have a plurality of notches, the coupling springs fit on the couplings, each coupling has a plurality of lug ribs, the notches of each of the rotating discs is selectively engageable with the lug ribs of the coupling, and the shaft penetrates through every coupling; a key lock, having a lock cylinder and a sleeve set, wherein the back of the lock cylinder is inserted in the sleeve set, the sleeve set partially located in the locating ring, and the sleeve set has two first flat grooves, a second flat groove, and a third flat groove; and a control piece set, having a first control piece, a second control piece, and a third control piece, wherein the first control piece, the second control piece, and the third control piece are pushed on the sleeve set.

In order to further understand the techniques, means and effects the present invention applies for achieving the described objectives, the following detailed description and included drawings are hereby considered, such that, and through which, the purposes, features and aspects of the present invention can be thoroughly and concretely appreciated; however, the appended drawings are merely provided for reference and illustration, without any intention to be used for limiting the present invention.

DETAILED DESCRIPTION OF THE PREFERRED EMBODIMENTS

Figure 1:
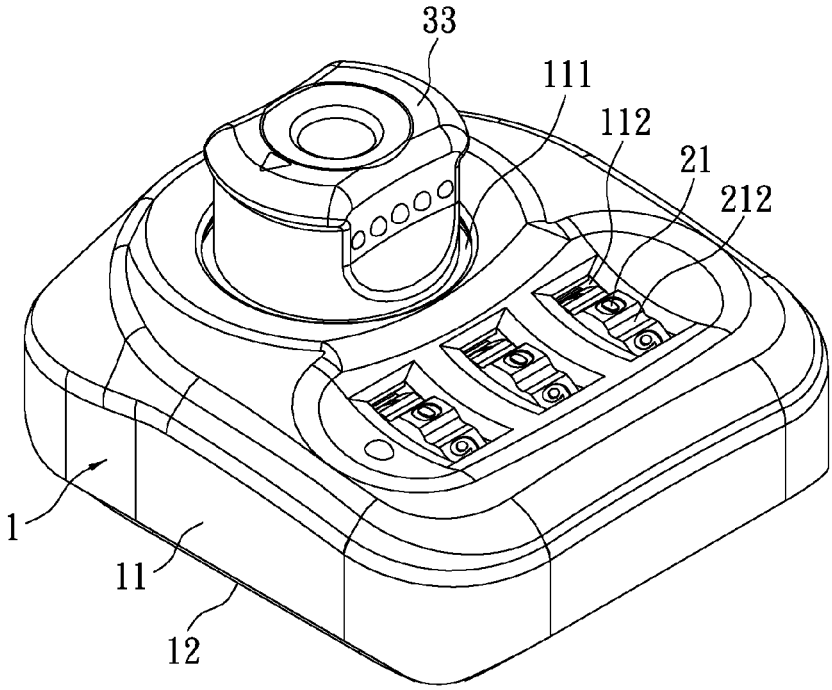
FIG. 1 is an assembled perspective view of the present invention.
Figure 2:
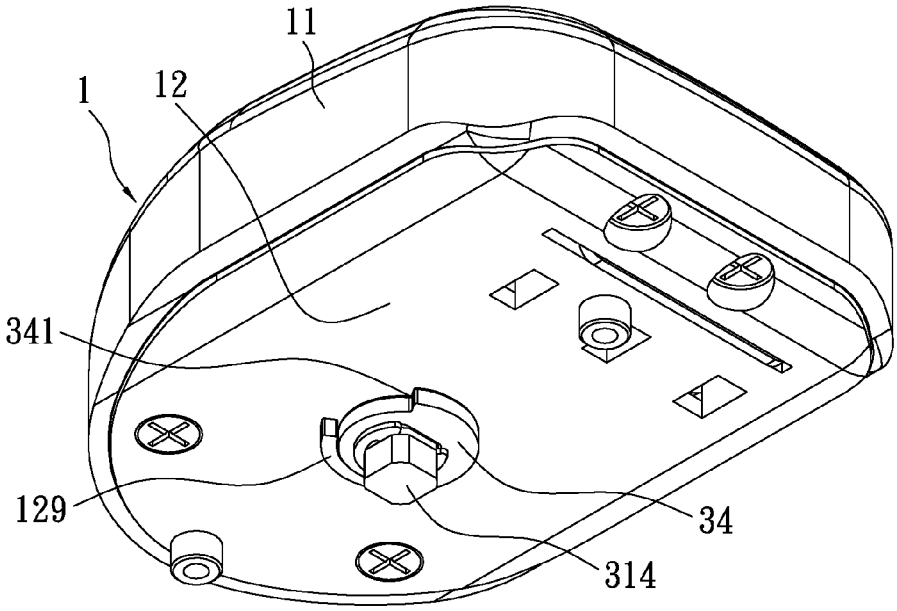
FIG. 2 is an another assembled perspective view of the present invention.
Figure 3:
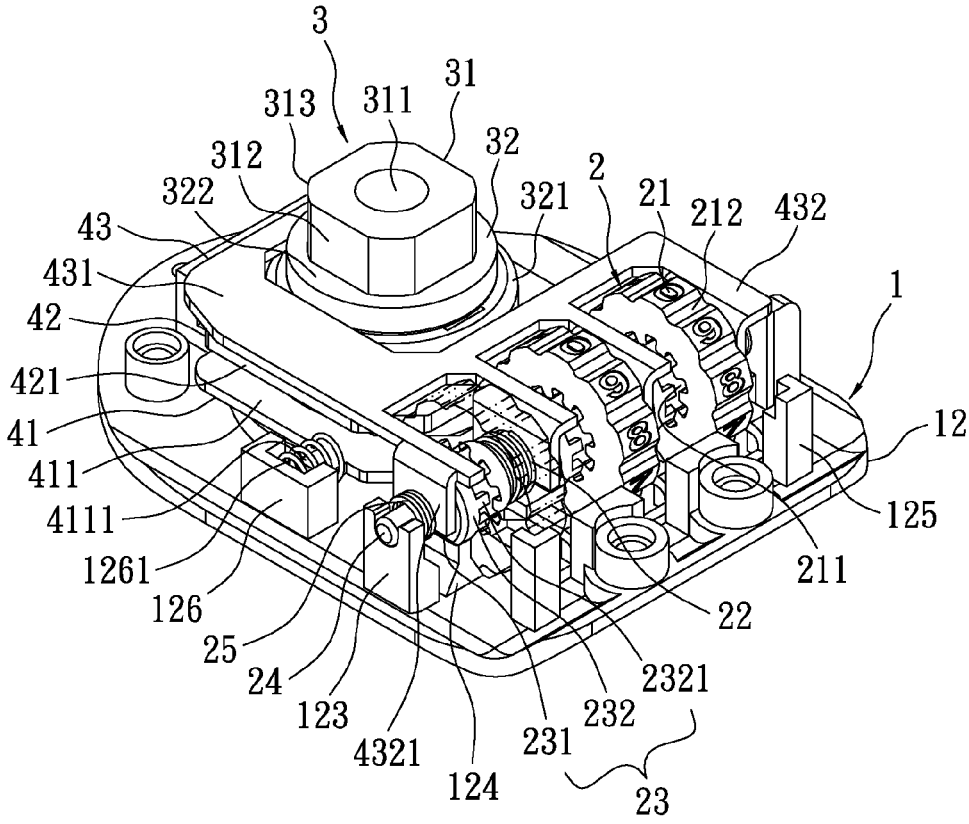
FIG. 3 is an assembled perspective view of the inner structure of the present invention.

Please refer to FIGS. 1 through 5. The present invention provides a double system lock apparatus. The double system lock apparatus comprises a lock shell 1, a combination lock 2, a key lock 3, and a control piece set 4.

The lock shell 1 includes a panel 11 and a main base 12 assembled with each other. The panel 11 has a round, or other shape penetrating hole 111 passing through it and three windows 112. The windows 112 are arranged in a row.

The main base 12 has a locating ring 121, an opening passing through or a penetrating hole 122, two shaft bases 123, four flat bases 124, two supporting bases 125, a blocking wall 126, a first track 127, a second track 128, and a limiting curve portion 129. The locating ring 121 protrudes forward from the surface of the main base 12. The penetrating hole 122 is located at the core of the locating ring 121. The shaft bases 123 and the flat bases 124 protrude forward from the surface of the main base 12 and arranged in a row. The two shaft bases 123 were arranged at the two sides of the row. The front of each of shaft bases 123 has a hole. The front of each of the flat bases 124 is flat. Except the left side flat base 124, other flat bases 124 are shown in "L" shape. The supporting bases 125 are located below the row formed by the shaft bases 123 and the flat bases 124. The front-end of the supporting bases 125 have grooves which correspond to each other.

The blocking wall 126, the first track 127, and the second track 128 also protrudes forward from the surface of the main base 12. In the embodiment, the blocking wall 126 is located below the left side of the locating ring 121. The right side of the blocking wall 126 has a groove which accommodates a spring 1261. The first track 127 is located above the locating ring 121 and the second track 128 is located below the right side of the locating ring 121. The limiting curve portion 129 protrudes backward from the other surface of the base 12. The limiting curve portion 129 is shaped like an arc of a circle, which is about one-forth of the circumference.

The combination lock 2 is arranged at the lower part of the main base 12. The combination lock 2 has three rotating discs 21, three coupling springs 22, three couplings 23, a shaft 24, a spring 25, and a locating portion 26. In the embodiment, the number of the rotating discs 21 is just for example and it is not limited when the present invention is in used. The rotating discs 21 partially penetrate through the windows 112. The core of each of the rotating discs 21 is void. On one side of the rotating disc 21, the edge closed to the hole of the rotating disc 21 has a plurality of notches 211. The number of the notches 211 is corresponding to that of the numbers of the rotating discs 21. The periphery of each of the rotating discs 21 has a plurality of locating indentations 212 arranged in equal distance. On the other side of the rotating disc 21, between the periphery of the rotating discs 21 and the edge of the hole located a plurality of anti-slip grooves 213. The number of the anti-slip grooves 213 is corresponding to that of the numbers/characters of the rotating discs 21. Each coupling 23 has a flat portion 231 and a lug 232. The flat portion 231 is located on one side of the coupling 23. The lug 232 is formed on the edge of the flat portion 231. A plurality of lug ribs 2321 extend from the edge of the lug 232. Each rotating disc 21 fits over each coupling 23. The notches 211 of the rotating disc 21 selectively engage with the lug ribs 2321 of the lug 232. The coupling spring 22 fits on the other side of the coupling 23 thereby separating the adjacent coupling spring 22. The shaft 24 penetrates through every coupling 23. The shaft 24 has a pushing ring 241 and an embedded ring 242. The pushing ring 241 is located near the left side of the left coupling 22. The two ends of the shaft 24 penetrate through the holes of the shaft base 123. The three rotating disc 21 are arranged among the four flat bases 123. The embedded ring 242 is partially embedded on the shaft 24.

By the perspective of the figure, when the right end of the shaft 24 is forced and intended to move left, if the three flat portions 231 of the three couplings 23 are corresponding to the fronts of the flat bases 124 each of which is near the right side of each coupling 23, the shaft 24 can move leftward. In the meantime, the three flat portions 231 of the three couplings 23 are located in front of the flat bases 124, and the lug ribs 2321 of the lugs 232 separate from the notches 211 of the rotating disc 21. In this way, the user can rotate the rotating discs 21 to reset a password of the rotating discs 21. When the password is decided and the left coupling 23 is forced (spring 25 offers) to move right, the notches 211 of the rotating discs 21 engage with the lug ribs 2321 of the lugs 232 again, and therefore the procedure of the password settlement is done. The engagement relationship between the lug ribs 2321 and the notches 211 is corresponding to the password the user choose. If there is at least one flat portion 231 unable to corresponding to the front of one of the flat bases 124, the lug 232 of the coupling 23 is blocked by the left side of the flat base 124, letting the flat base 124 unable to move leftward, although the right end of the shaft 24 is forced. This is the circumstance that the password is settled and the rotating discs 21 are not corresponding to the password.

The locating portion 26 is located on the grooves of the supporting bases 125. The locating portion 26 has three locating curves 261. The two ends of each of the locating curve 261 are corresponding to the locating indentations 212 of the rotating disc 21, making the rotating disc not so easy to rotate.

The key lock 3 has a lock cylinder 31, a sleeve set 32, a knob 33, and a limiting piece 34. The sleeve set 32 has a lock sleeve 321 and a lock ring 322.

The lock cylinder 31 has a key hole 311, four flat surfaces 312, four curved surfaces 313, a lock shaft 314, and a lock pin 315. The back of the lock cylinder 31 is inserted in the lock sleeve 321. The key hole 311 which can be inserted into a key (not shown in the figures) is arranged in the front of the lock cylinder 31. The four flat surfaces 312 and the four curved surfaces 313 are arranged alternately on the side of the front of the lock cylinder 31. The lock shaft 314 is formed on the back of the lock cylinder 31. The lock shaft 314 penetrates through the penetrating hole 122 of the main base 12 and the limiting piece 34. The lock pin 315 can selectively protrude from the side of the lock cylinder 31.

The lock sleeve 321 is partially located in the locating ring 121 thereby located. The inner of the lock sleeve 321 has a pin groove 3211. The pin groove 3211 and the lock pin 315 are selectively engaged with each other. When the pin groove 3211 and the lock pin 315 are engaged with each other, the lock cylinder 31 and the lock sleeve 321 can be rotated at the same time; when the pin groove 3211 and the lock pin 315 are not engaged with each other, the lock cylinder 31 can be rotated alone, relative to the lock sleeve. From back to front, the side of the lock sleeve 321 has two first flat grooves 3212 and a second flat groove 3213. The two first flat grooves are not continuously arranged.

The lock ring 322 surrounds on the forward portion of the lock cylinder 31 and be located in front of the lock sleeve 321 which has larger radius. The shape (inner periphery) of the lock ring 322 is corresponding to that of the forward portion of the lock cylinder 31, such that the lock ring 322 can be rotated with the lock cylinder 31. The lock ring 322 has a third flat groove 3221 on its side. The knob 33 is engaged with the forward portion of the lock cylinder 31. The shape of the inner of the knob 33 is corresponding to the forward portion of the lock cylinder 31 for users to rotate the lock cylinder 31. The limiting piece 34 is engaged with the lock shaft 314. The shape of limiting piece 34 comprises substantially two half-circles in different radius assembled with each other. The interfaces of the two half-circles are formed two limiting portion 341. The two limiting portion 341 are selectively contact with the two ends of the limiting curve portion 129, in order that when the user rotate the lock sleeve 321, the rotating angle is limited between zero and ninety degrees.

From back to front, the control piece set 4 has a first control piece 41, a second control piece 42, and a third control piece 43.

Figure 5:
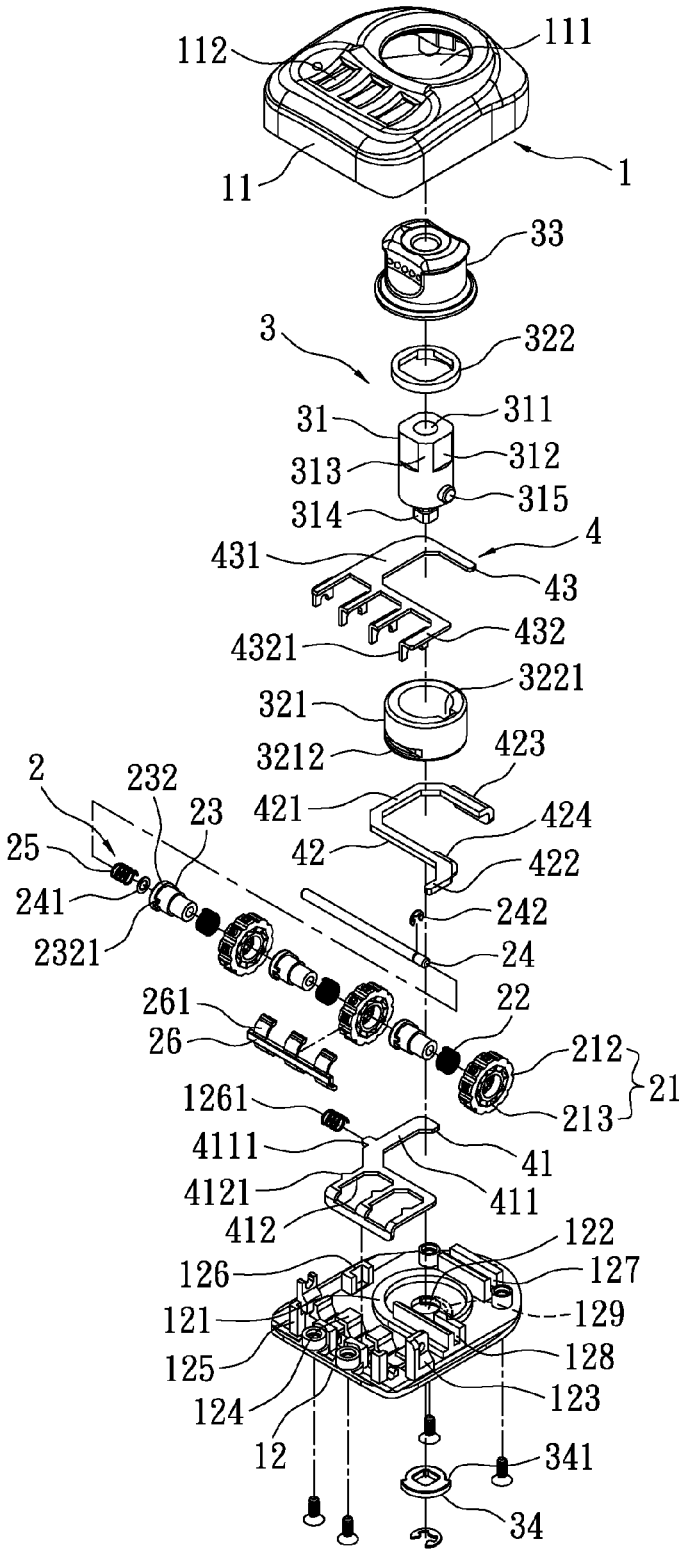
FIG. 5 is an another exploded perspective view of the present invention.
Figure 6A:
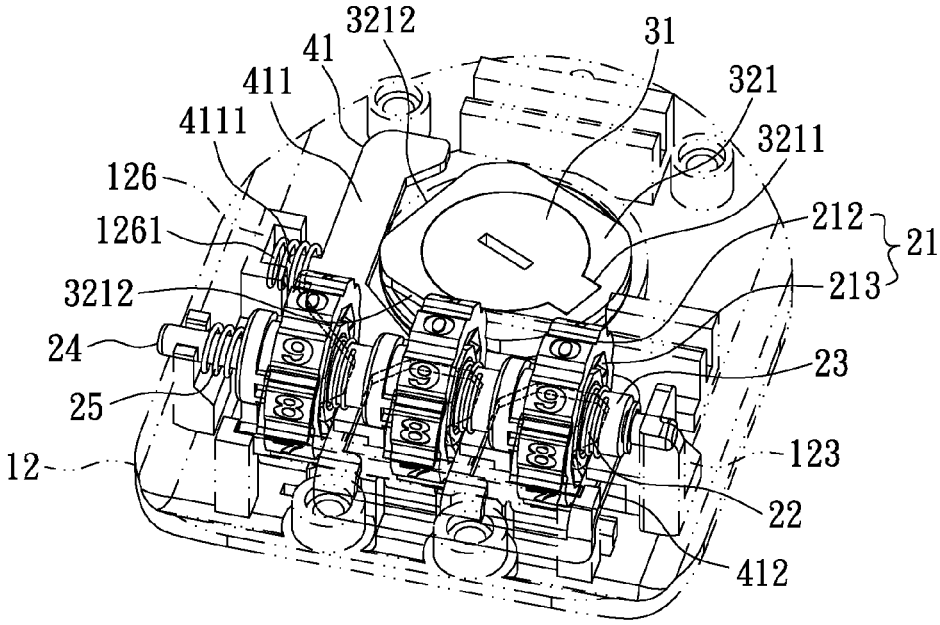
FIG. 6A is a schematic view of the first control piece engaging with the rotating lock sleeve of the present invention.
Figure 6B:
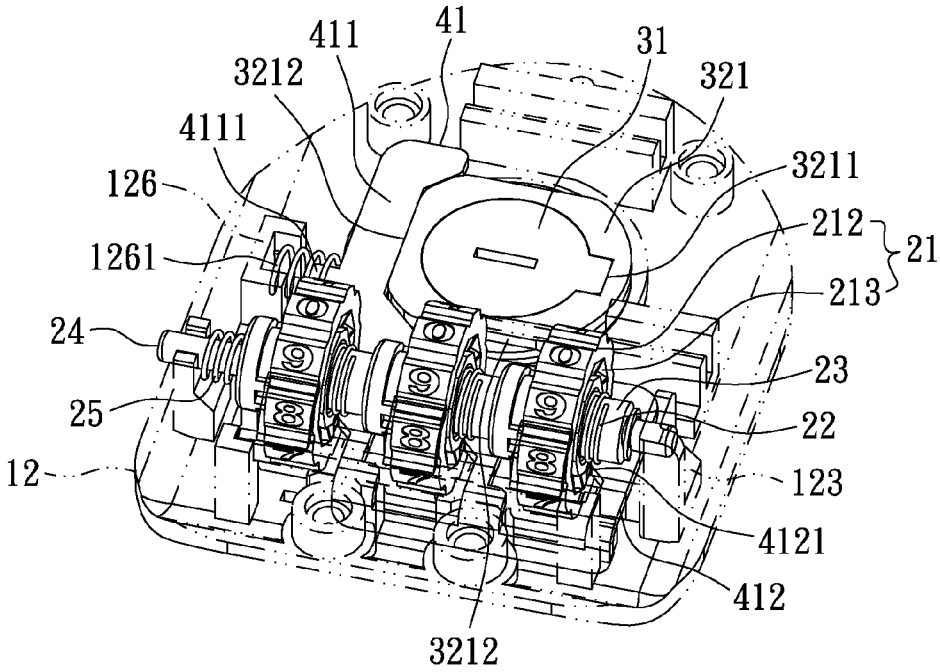
FIG. 6B is a schematic view of the first control piece engaging with the post-rotation lock sleeve of the present invention.

Referring to FIG. 5, FIG. 6A, and FIG. 6B (without concerning that the second control piece 42 exert force on the shaft 24), the first control piece 41 has a main-pushing rod 411 and three sub-pushing rods 412. On side of the main-pushing rod 411 has a protrusion 4111. The protrusion 4111 inserts into one side of the spring 1261, letting the main-pushing portion 411 is forced to move right. The lower part of the main-pushing portion 411 extends horizontally, and the extension part forms the three sub-pushing rods 412. The three sub-pushing rods 412 are arranged near the back of the right three flat bases 124. The left side of each sub-pushing rods 412 protrudes a thorn 4121. The thorn 4121 selectively engages with the anti-slip groove 23 of one of the rotating discs 21. The spring 1261 pushes the main-pushing rod 411 rightward into the first flat groove 3212. When the lock sleeve 321 is rotated ninety degrees, main-pushing rod 411 is pushed to the other first flat groove 3211. During the process of the rotation of the lock sleeve 321, the main-pushing rod 411 leaves from the original first flat groove 3212, and then the side of the lock sleeve 321 push leftward to the main-pushing rod 411 decreasing the length of the spring 1261. At the same time, the thorns 4121 of the sub-pushing rods 412 engaged with the anti-slip grooves 213 of rotating discs 21, preventing the rotating discs 21 from rotating. Later, when the main-pushing rod 411 is pushed to the other the first flat groove 3212, the thorns 4121 of the sub-pushing rods 412 leave the anti-slip grooves 213 of rotating discs 21, and the rotating discs 21 can be rotated again. In this way, when the user has already set the password, he/she will not unintentionally rotate the rotating discs 21 to change the password in the rotation process of the lock sleeve 321 rotated by the knob 33.

Figure 4:
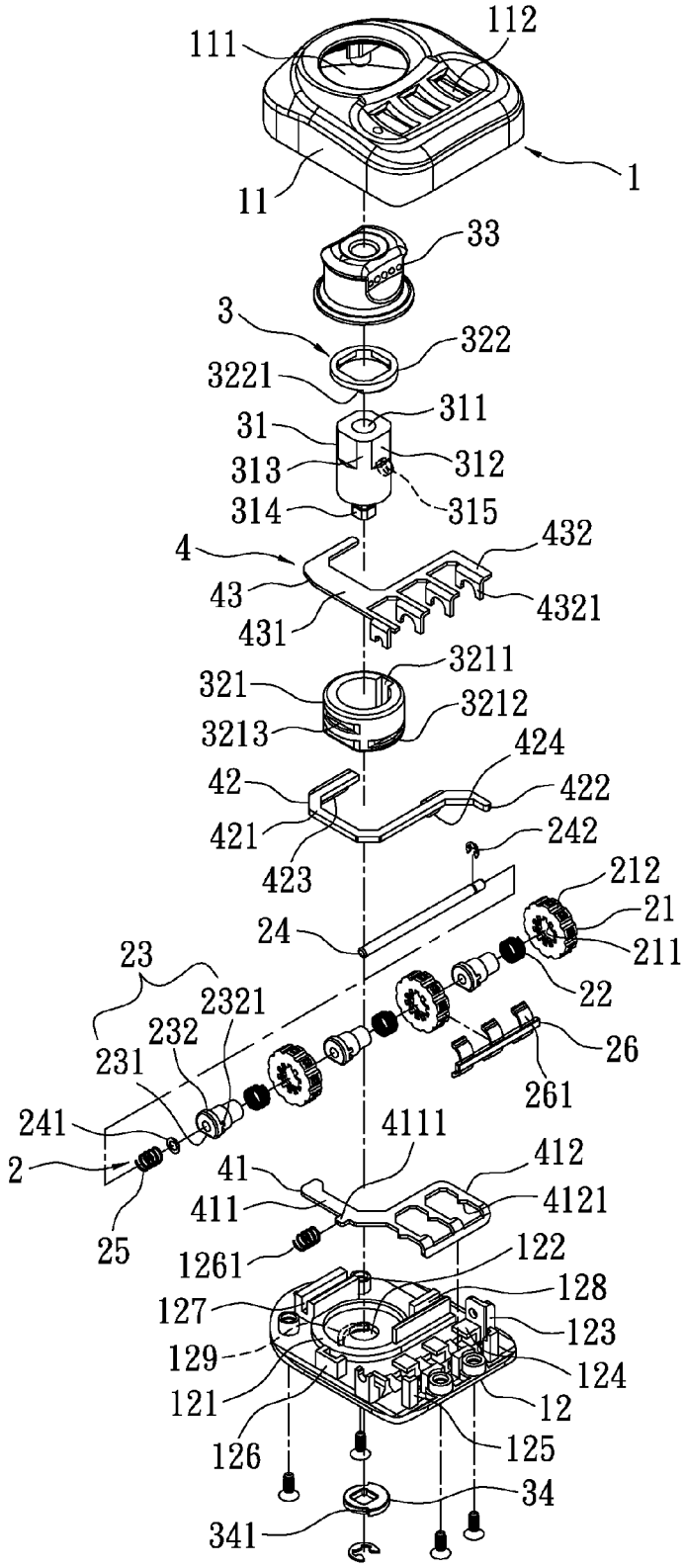
FIG. 4 is an exploded perspective view of the present invention.
Figure 7A:
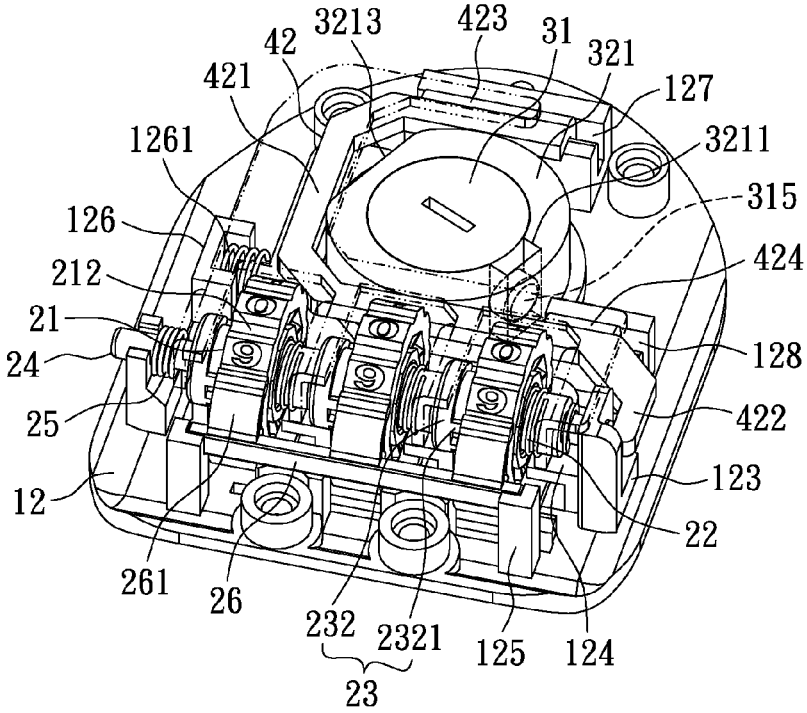
FIG. 7A is a schematic view of the second control piece engaging with the rotating lock sleeve of the present invention.
Figure 7B:
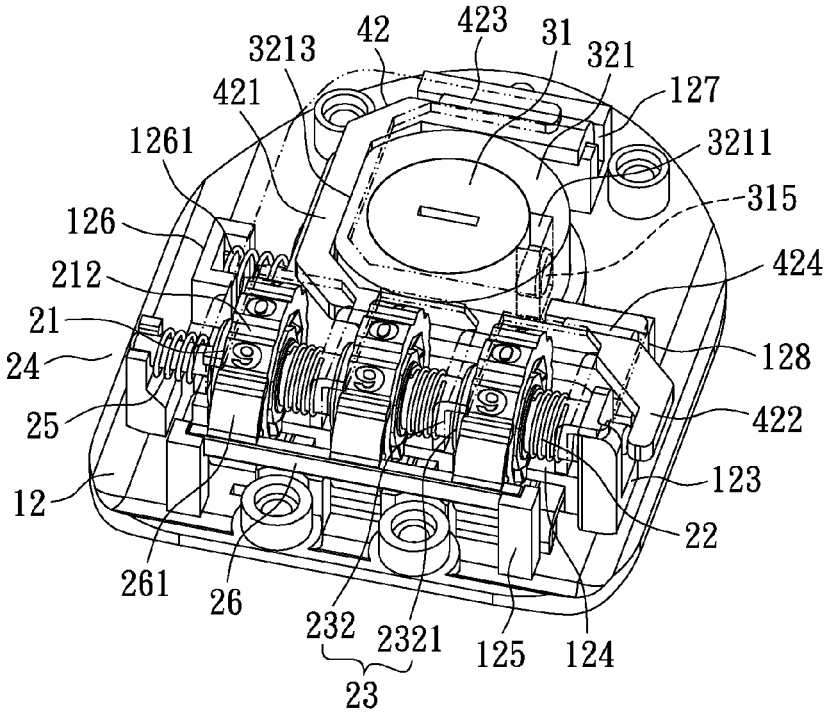
FIG. 7B is a schematic view of the second control piece engaging with the post-rotation lock sleeve of the present invention.
Figure 8A:
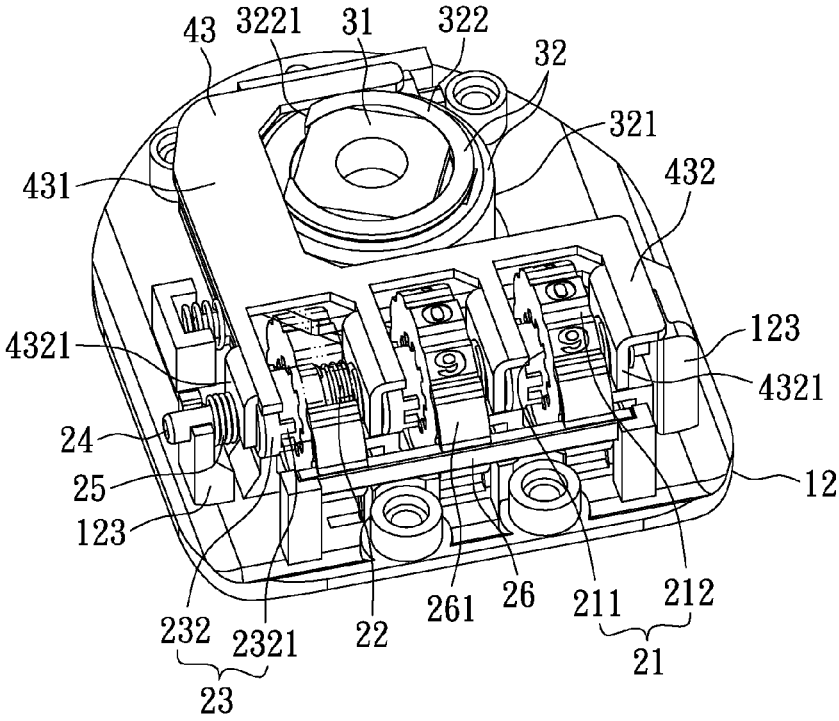
FIG. 8A is a schematic view of the third control piece engaging with the rotating lock ring of the present invention.
Figure 8B:
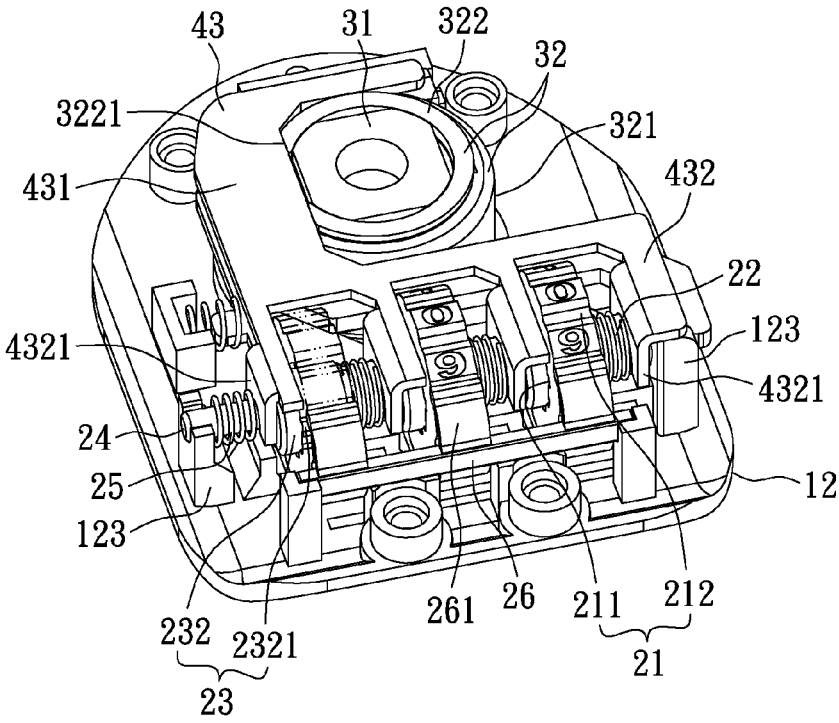
FIG. 8B is a schematic view of the third control piece engaging with the post-rotation lock ring of the present invention.

Referring to FIG. 4, FIG. 7A, and FIG. 7B, the second control piece 42 has a main-pushing rod 421 and a pushing portion 422. The upper end of the main-pushing portion 411 extends horizontally, the upper of its extension protruding backward to form a first sliding piece 423. The first sliding piece 423 slides left or right in the first track 127. The lower end of the main-pushing rod 421 extends horizontally, and the extension is bent downward to form the pushing portion 422. The upper of the extension protrudes to form a second sliding piece 424. The second sliding piece 424 slides left or right in the second track 128. The pushing portion 422 contacts the right end of the shaft 24. The main-pushing rod 421 is pushed on the left side of the lock sleeve 321. The pushing portion 422 is forced to contact the right end of the shaft 24 thereby offering a force leftward to compress the spring 25. When the lock sleeve 321 is rotated ninety degrees (counter clockwise, CCW), the main-pushing rod 421 is corresponding to the second flat groove 3213 of the lock sleeve 321, and the spring 25 push the pushing ring 241 to make the shaft 24 move rightward, such that the pushing portion 422 move rightward, and therefore the main-pushing rod 421 is pushed to the second flat groove 3213. The shaft 24 moving rightward results to the coupling 23 move rightward at the same time, letting the notches 211 of the rotating disc 21 engaged with the lug ribs 2321.

Referring to FIG. 3, FIG. 4, FIG. 8A, and FIG. 8B, the third control piece 43 is force to contact on the lock ring 322. The main purpose of settling the third control piece 43 in the present invention is that when the combination lock 2 is locked and the user forget the password, the third control piece 43 can help to reset the password. The third control piece 43 has a main-pushing rod 431 and four sub-pushing rods 432. The lower part of the main-pushing portion 431 extends rightward horizontally, and the extension part forms downward the four sub-pushing rods 432. The main-pushing rod 431 is partially located in front of the lock sleeve 321. In the embodiment, the three rotating discs 21 are arranged among the four sub-pushing rods 432. Each sub-pushing rod 432 protrudes backward to form an exerting portion 4321. The exerting portion 4321 contacts with the combination lock 2. The edge of the left exerting portion 4321 is "C" shaped, contacts with the shaft 24, and blocks the right side of the spring 25. The edges of the other three exerting portions 4321 are "C" shaped, contact with the sides of the couplings 23, and block the right sides of the coupling springs 22. The main-pushing rod 431 is pushed to the side of the lock ring 322. When the user rotate the knob 33 to rotate the lock cylinder 31 and further to rotate the lock sleeve 321 ninety degrees (counter clock-wise, CCW), the main-pushing rod 431 is corresponding to the third flat groove 3221 of the lock ring 322. Part of the elastic force of the spring 25 is exerted rightward to the left exerting portion 4321; part of the elastic force of the other three coupling springs 22 are exerted rightward to the other three exerting portion 4321. The third control piece 43 moves rightward by the exerting portions 4321, and therefore the main-pushing rod 431 is pushed to the third flat groove 3221. When the user forgets the password and uses the key to unlock the present invention, the lock pin 315 of the lock cylinder 31 leaves the pin groove 3211 of the lock sleeve 321 and draws back to the inner of the lock cylinder 31. The lock cylinder 31 along with the lock ring 322 rotate ninety degrees (clockwise, CW) relative to the lock sleeve 321 to unlock the present invention. At the same time, the main-pushing rod 431 leaves the third flat groove 3221 of the lock ring 322 and then contacts with the side of the lock ring 322, making the exerting portions 4321 push the spring 25 and the coupling springs 22 to move leftward. Then, the user rotates each rotating disc 21 three hundred sixty degrees from left to right. In the process of the rotation, the couplings 23 which engaged with the rotating discs 21 are continuously pushed by the elastic force of the coupling springs 22. The coupling springs 22 push leftward. When each of the flat portion 231 of the coupling 22 is corresponding to the front of the flat base 124 in the process of the rotation, the flat portion 231 of the coupling 22 move rightward in front of the flat base 124. The lug ribs 2321 of the coupling 22 leave the notches 211 of the rotating disc 21. When all the lug ribs 2321 of the coupling 22 leave the notches 211 of all the rotating discs, it is available to reset new password of the combination lock 2.

When the lock cylinder 31, along with the lock ring, 322 rotate ninety degrees (counter clockwise, CCW) relative to the lock sleeve 321 to lock the present invention, the lock pin 315 of the lock cylinder 31 penetrates through the side of the lock cylinder 31 and then inserts into the pin groove 3211 of the lock sleeve 321. The pin groove 3211 and the lock pin 315 are engaged with each other again.

The above-mentioned descriptions represent merely the preferred embodiment of the present invention, without any intention to limit the scope of the present invention thereto. Various equivalent changes, alternations or modifications based on the claims of present invention are all consequently viewed as encompassing the scope of the present invention.

What is claimed is:

1. A double system lock apparatus, comprising: a lock shell, having a panel and a main base assembled with each other, wherein the panel has a penetrating hole and a plurality of windows arranged in a row, and the main base has a locating ring, a penetrating hole, and a plurality of flat bases; a combination lock, having a plurality of rotating discs, coupling springs, couplings, and a shaft, wherein the rotating discs have a plurality of notches, the coupling springs fit on the couplings, each coupling has a plurality of lug ribs, the notches of each of the rotating discs is selectively engageable with the lug ribs of the coupling, and the shaft penetrates through every coupling; a key lock, having a lock cylinder and a sleeve set, wherein the back of the lock cylinder is inserted in the sleeve set, the sleeve set partially located in the locating ring, and the sleeve set has two first flat grooves, a second flat groove, and a third flat groove; and a control piece set, having a first control piece, a second control piece, and a third control piece, wherein the first control piece, the second control piece, and the third control piece are pushed on the sleeve set.

2. The double system lock apparatus as claimed in claim 1, wherein the sleeve set has a lock sleeve and a lock ring, the lock sleeve is partially located in the locating ring thereby located, the side of the lock sleeve has the first flat grooves and the second flat groove from back to front, and the lock ring has the third flat groove.

3. The double system lock apparatus as claimed in claim 2, wherein the main base has a blocking wall, one side of the blocking wall has a groove which accommodates a spring, and the first control piece has a main-pushing rod, one side of the main-pushing rod has a protrusion inserting into one side of the spring.

4. The double system lock apparatus as claimed in claim 3, wherein the rotating discs have a plurality of anti-slip grooves, the first control piece has a plurality of sub-pushing rods, one side of each sub-pushing rods protrudes a thorn, the thorn is selectively engageable with the anti-slip groove of one of the rotating discs.

5. The double system lock apparatus as claimed in claim 3, wherein the main-pushing rod is pushed in to one of the first flat grooves.

6. The double system lock apparatus as claimed in claim 2, wherein the second control piece has a main-pushing rod and a pushing portion, and the pushing portion is forced to contact one end of the shaft.

7. The double system lock apparatus as claimed in claim 6, wherein the main base has a first track, the upper end of the main-pushing rod extends horizontally, the upper of an extension of the main-pushing portion protruding backward to form a first sliding piece, and the first sliding piece slides left or right in the first track.

8. The double system lock apparatus as claimed in claim 6, wherein the main-pushing rod of the second control piece is pushed on the one side of the lock sleeve or is pushed to the second flat groove.

9. The double system lock apparatus as claimed in claim 3, wherein the third control piece has a main-pushing rod and a plurality of sub-pushing rods, each sub-pushing rod protrudes backward to form an exerting portion, the edges of the exerting portions contact with the sides of the spring or the couplings, and the main-pushing rod of the third control piece is pushed to the side of the lock ring or the third flat groove.

10. The double system lock apparatus as claimed in claim 1, wherein the main base has a plurality of supporting bases, the combination lock has locating portion located on the supporting bases, the locating portion has a plurality of locating curves, the periphery of each of the rotating discs has a plurality of locating indentations arranged in equal distance, the two ends of each of the locating curves are corresponding to the locating indentations of the rotating disc.

* * * * *